US006142027A

United States Patent [19]

Thompson

[11] Patent Number: 6,142,027

[45] Date of Patent: Nov. 7, 2000

[54] METHOD AND APPARATUS FOR CALIBRATING A DENSITOMETER BASED SENSOR FOR SHOT PEENING

[75] Inventor: Robert Alan Thompson, New York, N.Y.

[73] Assignee: General Electric Company, Schenectady, N.Y.

[21] Appl. No.: 08/317,066

[22] Filed: Oct. 3, 1994

[51] Int. Cl.[7] ..... G01F 25/00; G01N 9/00

[52] U.S. Cl. ..... 73/866.4; 73/1.01; 73/1.36

[58] Field of Search ..... 73/1 R, 866.4, 73/11.02, 14 DV, 2, 3, 865.6; 72/53, 76, 31.06

[56] References Cited

U.S. PATENT DOCUMENTS

| | | | |
|---|---|---|---|
| 4,203,315 | 5/1980 | Vien et al. | 73/14 DV |
| 4,406,153 | 9/1983 | Ophir et al. | 73/14 DV |
| 4,453,408 | 6/1984 | Clayman | 73/14 DV |
| 4,805,429 | 2/1989 | Thompson | 72/53 |
| 4,843,866 | 7/1989 | Molsen et al. | 73/14 DV |
| 4,848,123 | 7/1989 | Thompson | 73/11.02 X |
| 4,873,855 | 10/1989 | Thompson | 72/53 |
| 5,176,018 | 1/1993 | Thompson | 72/53 |
| 5,204,826 | 4/1993 | Thompson et al. | 364/552 |
| 5,226,331 | 7/1993 | Thompson et al. | 73/865.9 |
| 5,235,517 | 8/1993 | Thompson et al. | 364/473 |
| 5,271,255 | 12/1993 | Thompson | 72/53 |
| 5,271,282 | 12/1993 | Thompson | 73/862.08 |
| 5,293,320 | 3/1994 | Thompson et al. | 364/474.02 |
| 5,327,755 | 7/1994 | Thompson | 72/53 |

FOREIGN PATENT DOCUMENTS

| | | | |
|---|---|---|---|
| 220609 | 6/1968 | U.S.S.R. | 73/866.4 |

*Primary Examiner*—Thomas P. Noland
*Attorney, Agent, or Firm*—Marvin Snyder

[57] ABSTRACT

An apparatus and method are provided for calibrating a densitometer based sensor for measuring the linear density of the shot particles passing through a shot peening system to ensure that mass flow rate readings and shot velocity readings calculated therefrom are accurate. The apparatus comprises a probe having a plurality of randomly distributed particles configured to have a linear density substantially equal to the linear density of shot which the sensor should experience during operation of the shot peening system at desired parameters. The method comprises recording a sensor reading of the particles of the probe with the probe inserted in the sensor, removing the probe, dividing the known linear particle density of the probe by the sensor output to obtain the sensor calibration constant and multiplying each subsequent sensor output taken during normal operation of the shot peening system by the calibration constant to obtain an accurate instantaneous linear density reading of the shot traveling through the shot peening system.

5 Claims, 2 Drawing Sheets

METHOD AND APPARATUS FOR CALIBRATING A DENSITOMETER BASED SENSOR FOR SHOT PEENING

BACKGROUND OF THE INVENTION

1. Field of the Invention

The instant invention relates generally to a method and apparatus for calibrating a densitometer based sensor used to measure the density of shot within a given field. Obtaining the density of shot affords the ability to calculate the mass flow rate of shot in the system and the velocity of the shot leaving the system. If precise density readings are obtained, an operator may properly adjust the system to ensure that a required amount of shot leaves the system at a required velocity.

The instant invention therefore provides a quick and inexpensive way to determine the calibration constant of a densitometer based sensor. More specifically, the instant invention provides a way to determine the calibration constant of a densitometer based sensor used to measure the density of shot within a portion of a shot peening apparatus. The instant invention therefore ensures that a shot peening system meters are indicating the true operating parameters.

2. Description of the Related Art

The use of shot peening is relatively well known. In particular, a stream of shot (i.e. particles) is directed at the surface at a high velocity. The shot is directed at a work piece so as to cause plastic deformation of the surface of the work piece, often a metal surface. The shot peening is often used to increase fatigue strength, although the process may be applied for other purposes.

Various shot peening devices and techniques have been developed over the years. Shot peening systems, generally, have (or can be readily equipped with) mass flow controllers. Such controllers are used to control the flow of shot to the shot peening gun. One common type of mass flow controller for use with shot made from ferromagnetic material has an electromagnet which is pulsed in order to allow passage of a metered amount of shot into a shot peening gun. This and other common types of mass flow controller use internal feedback from a densitometer based sensor to stabilize the mass flow rate (i.e. the amount of shot metered in a given time). A control may be used to set the mass flow rate to a desired value. A display may be used to indicate the flow rate.

The quality of work accomplished by the shot peening apparatus depends on the velocity of the shot as well as the mass flow rate thereof. U.S. Pat. No. 4,805,429 to the instant inventor and assigned to the same assignee as the instant invention, discloses the extent of the importance of such velocity in a shot peening operation. Problems can arise when the sensor monitoring the mass flow rate or the nozzle velocity are not properly calibrated. Under-peening can lead to gaps in the surface compressive layer while over-peening can lead to embrittlement and damage. Similarly, the correct shot velocity assures that the depth of the compressive layer is maintained. Thus, it is vital to the shot peening process that the shot flow rate and velocity be accurately measured and controlled at all times.

In U.S. Pat. Nos. 4,873,855 and 5,176,018, assigned to the instant assignee, the instant inventor disclosed magnetic and densitometer based capacitance sensors, respectively, and each is hereby incorporated by reference. Each said disclosure also describes in detail how the sensors are used in a shot peening system to indicate the shot mass flow rate within the system and the shot velocity as the shot leaves the system.

U.S. Pat. No. 5,226,331 to R. A. Thompson et al and assigned to the same assignee as the instant invention discloses a prior apparatus for measuring the velocity and density of shot leaving the nozzle of a shot peening system. Prior to the instant invention, said prior apparatus was used to measure the velocity and density of shot leaving a shot peening system. The densitometer based sensors of the shot peening system were then calibrated to the readings taken.

The principle object of the instant invention is to provide a simpler and inexpensive means which is accurate and reliable for calibrating and insuring the accuracy of densitometer based shot peening sensors.

A further object of the instant invention is to provide a simpler and inexpensive method which is accurate and reliable for calibrating and insuring the accuracy of densitometer based shot peening sensors.

SUMMARY OF THE INVENTION

The above and other objects of the instant invention are accomplished by providing an improved apparatus and method for calibrating densitometer based sensors used for measuring shot density in a shot peening system. This is accomplished by providing a calibrating probe comprising a random distribution of shot particles wherein said distribution simulates the linear density of shot particles experienced by the sensor during normal operating conditions of the shot peening system. The shot particles may be of either ferromagnetic or non-ferromagnetic material dependent upon the shot employed by the shot peening system under inspection. Calibration is afforded by simple insertion of a probe of the instant invention into each sensor of a system to determine the calibration constant associated with each sensor. The subsequent outputs of each sensor are then adjusted according to said constant to ensure that the resulting readouts properly reflect the conditions existing within the system.

DETAILED DESCRIPTION OF THE PREFERRED EMBODIMENT

Figure 1A:
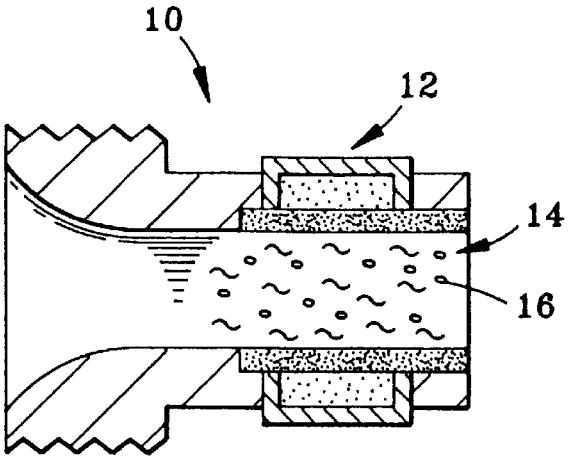
FIG. 1*a* depicts a nozzle of a shot peening system employing a densitometer based magnetic sensor operating under normal conditions.

FIG. 1*a* shows a nozzle 10 employing a densitometer based magnetic sensor 12 of the type disclosed in U.S. Pat.

Figure 1B:
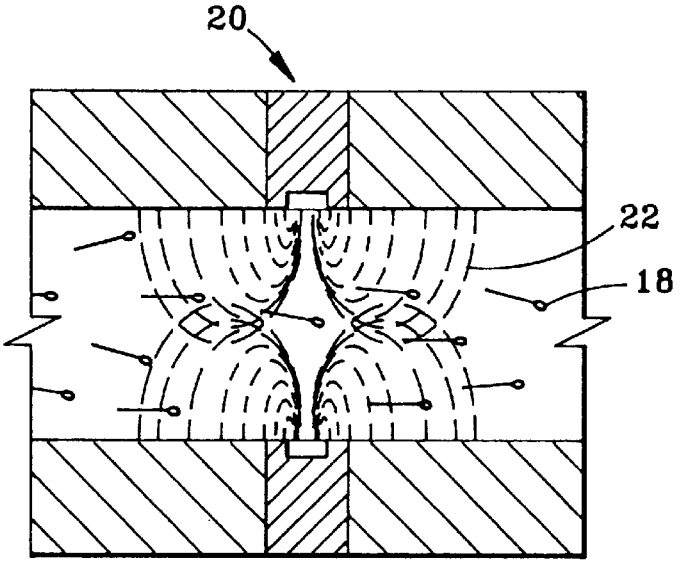
FIG. 1*b* depicts a nozzle of a shot peening system employing a densitometer based capacitance sensor operating under normal conditions.

No. 4,873,855. Sensor 12 measures the inductance of inductance field 14, wherein the inductance of the field is dependent upon the amount of ferromagnetic shot 16 within said inductance field 14. FIG. 1*b* shows a densitometer based capacitance sensor 20 of the type disclosed in U.S. Pat. No. 5,176,018. Sensor 20 measures the change in dielectric constant in its capacitance field 22. Shot 18 within the field will alter the dielectric constant of the sensor 20 by an amount proportionate to the amount of shot 18 within field 22. Densitometer based capacitance sensor 20 is typically employed for a system using non-ferromagnetic shot such as glass shot or ceramic shot, which would not alter inductance field 14 of densitometer based magnetic sensor 12. It is recognized, however, that densitometer based capacitance sensor 20 may be employed in a system using ferromagnetic shot.

In the case of each type of sensor 12, 20 the sensor measures the instantaneous amount of shot 16, 18 respectively therein. The respective measurements are then converted to an output voltage v by sensor 12, 20 which corresponds to that field magnitude. Once the output voltage v is obtained from a calibrated sensor 12, 20, it can be inserted in an equation $$d\ (particles/inch)=K\ (particles/inch\text{-}volt)\times v\ (volts) \quad (1)$$

where d=density of particles in the reading zone of sensor 12, 20 K=a calibration constant of sensor 12, 20 and v=the voltage output from the sensor 12, 20. An instantaneous average particle density per inch within the field 14, 22 is thereby determined for normal operating conditions of the shot peening system.

A quick, easy and inexpensive method and apparatus for obtaining the calibration constant K is the subject of the instant invention. A probe of the instant invention is used to determine the calibration constant K of each sensor 12, 20 within a shot peening system. Although each individual sensor 12, 20 of a particular type may have calibration constants K which are close in value, the exact value of each sensor is important in a shot peening system to ensure the proper operating conditions throughout as discussed above.

Figure 2:
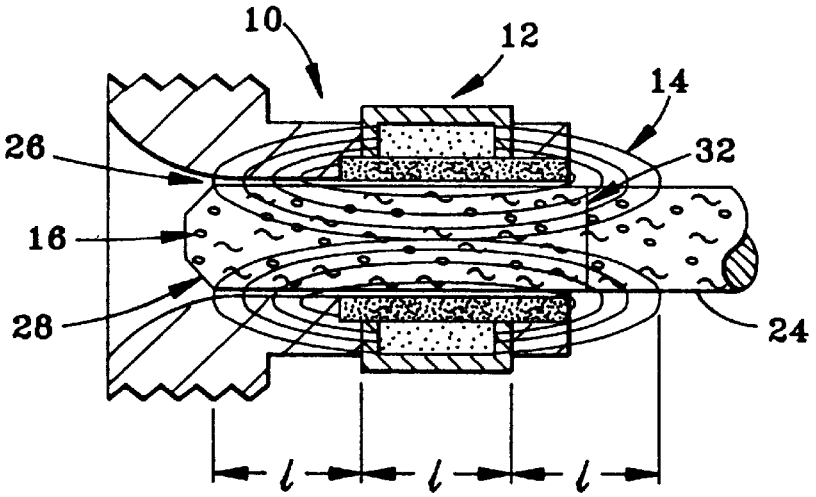
FIG. 2 depicts a substantially schematic view of a nozzle of a shot peening system employing a densitometer based magnetic sensor and a preferred embodiment calibrating probe for a densitometer based magnetic sensor of the instant invention inserted therein.

FIG. 2 depicts a typical shot peening system nozzle 10 employing a densitometer based magnetic sensor 12 and a probe 24 of a preferred embodiment of the instant invention inserted in nozzle 10. A densitometer based magnetic sensor 12 is used for the following illustration of obtaining the calibration constant K using a probe of the instant invention. It is to be understood that the same procedure would be used for determining the calibration constant K for a densitometer based capacitance sensor 20. It would also be apparent to one of ordinary skill in the art that the same procedure would be used for determining the calibration constant K for a densitometer based sensor of any type.

Probe 24 of the instant invention is configured to simulate an instantaneous linear density of shot 16 within the field 14 of sensor 12. To determine the calibration constant K, probe 24 is inserted into field 14 of sensor 12 to obtain the corresponding output voltage v from sensor 12. Because linear density d is known, equation (1) may be rearranged and the output voltage v may be insert in the resulting equation $$K=d/v \quad (2)$$

to determine the calibration constant K by dividing the known linear density d of the shot 16 within probe 14 by the output voltage v from sensor 12.

Once the calibration constant K is determined by the foregoing procedure, any instantaneous linear density d of shot 16 experienced during normal operating conditions of the shot peening system will be calculable from equation (1). The instantaneous linear density readings d may then be used to calculate an accurate instantaneous mass flow rate of the shot 16 as well as an accurate instantaneous nozzle velocity of shot 16 as described in detail in aforementioned U.S. Pat. No. 5,176,018.

It is anticipated that linear density, mass flow rate and velocity readings may be obtained by having calibration constant K adjust output voltage v by means of an electrical circuit through which output voltage v is run, or by programming calibration constant K in a computer program designed to monitor the linear density, the mass flow rate or the nozzle velocity.

Figure 3A:
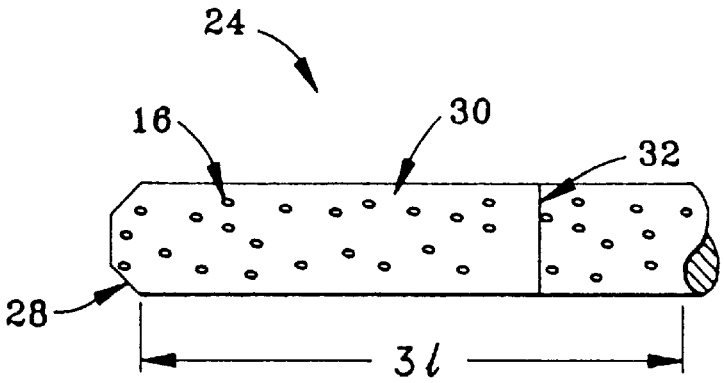
FIG. 3*a* depicts a substantially schematic view of a preferred embodiment probe for a densitometer based magnetic sensor of the instant invention.

FIG. 3*a* depicts a preferred embodiment probe 24, for use with a densitometer based magnetic sensor 12, comprises ferromagnetic shot particles 16, of the type employed by the shot peening system, embedded in a encasing material 30. Material 30 could be any suitable resin, such as polyethylene, as will be evident to one skilled in the art. It is recognized that probe 24 need not be of a resin however. Probe 24 may be made from any composition not comprising ferromagnetic material. In a preferred embodiment, material 30 is polyethylene such that probe 24 will not disturb the polyethylene inner diameter at sensor 12 as described in aforementioned U.S. Pat. No. 4,873,855. Shot 16 is disposed within material 30 in a randomly distributed configuration to hold the shot 16 in said distributed configuration. The longitudinal distribution of shot 16 within probe 24 is configured to simulate the linear density d of shot 16 which the sensor 12 would experience during desired operating conditions of the shot peening system. In this manner, a sensor reading taken from the distribution of the shot 16 within probe 24 will simulate an instantaneous reading of shot flow during operation of the shot peening systsem at the desired parameters.

It has been discovered that for densitometer based magnetic sensors, the radial distribution of shot 16 within probe 24 makes an insignificant difference in the readings obtained for calibrating sensor 12. Probe 24 could therefore comprise shot 16 distributed in a random radial distribution as would be experienced in operation of the shot peening system, or shot 16 could be distributed in any manner which would allow a simpler construction of probe 24 as will be evident to one of ordinary skill in the art. In either case the axial distribution should simulate the linear density of shot 16 that of the shot peening system would experience at desired operating parameters. It is, however recognized that calibration of sensor 12 could be accomplished with an axial distribution of shot 16 within probe 24 of a linear density other than that at which the shot peening system is desired to operate; so long as its density d is known.

The outer diameter of probe 24 is substantially the same size as the inner diameter of nozzle 10 as shown in FIG. 2. A clearance 26 is left between the probe 24 and the nozzle 10 just large enough to provide for insertion of the probe 24 into nozzle 10 without undo difficulty. To further ease the insertion of probe 24 into nozzle 10, the leading tip comprises a chamfer 28 for guiding it into nozzle 10.

FIGS. 2 and 3*a* show the length of probe 24 to be at least three times the length of the sensor 12 to be calibrated. When calibrating sensor 12, a portion of probe 24 equal in length to the length of sensor 12 should be disposed on each side of sensor 12. This ensures that the entire inductance field 14 experiences the shot distribution of probe 24. To aid the operator calibrating sensor 12 an indicator 32 may be placed on probe 24. Probe 24 would then be inserted into the nozzle 10 up to the indicator 32 at which point the probe would be properly disposed with respect to inductance field 14 as described above. Indicator 32 may be a simple line or groove on probe 24.

Figure 3B:
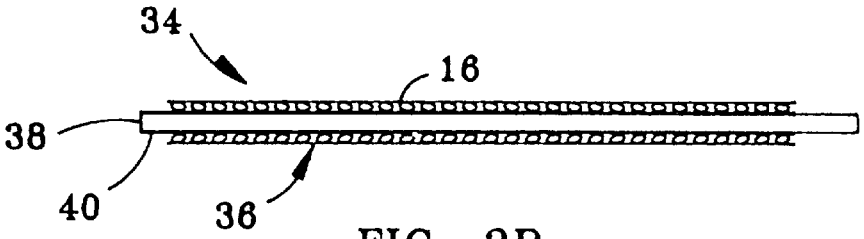
FIG. 3*b* depicts a substantially schematic view of a cross-section of an alternate embodiment probe for a densitometer based magnetic sensor of the instant invention.

As depicted in FIG. 3*b*, an alternate embodiment probe 34 of the instant invention for a densitometer based magnetic sensor represents a simple and easily constructed embodiment which can be made from supply found in most shops. Probe 34 employs an inner tape 40 having both sides comprising an adhesive such that a first side holds the shot 16 to inner tape 40 and a second side to hold inner tape 40 to a rod 38. As with encasing material 30 of probe 24, rod 38 may be of any convenient non-ferromagnetic material. In this manner, inner tape 40, and consequently shot 16, will be firmly held to rod 38. Shot 16 is disposed in a manner which results in a linear density d equal to that of the linear density of shot 16 experienced by said sensor 12 during desired operating conditions. As with probe 24, it is recognized that proper calibration may be accomplished with other linear densities. In such a configuration it is to be recognized that outer tape 36 may be placed over shot 16, which extends outward from inner tape 40, to protect shot 16 from incidental contact with sensor 12 which would tend to remove the shot 16 from inner tape 40 in the absence of outer tape 36. There are numerous variations of the embodiment of FIG. 3*b* which will accomplish the identification of the calibration constant of a densitometer based sensor and such variations do not depart from the instant invention.

One such variation of probe 34 of the instant invention for use with a densitometer based magnetic sensor 12 would be to remove inner tape 40. Outer tape 36 comprises adhesive on one side thereof is laid flat and shot 16 is disposed on the adhesive of said outer tape 36, in the same manner as it was applied to outer tape 40, along a length equal to at least three times the length of the sensor 12 to be calibrated. Outer tape 36 is then wrapped around a rod 38 such that shot 16 is disposed against rod 38. The longitudinal edges of said outer tape 36 are then connected to each other, thereby holding the outer tape 36 around rod 38.

Figure 3C:
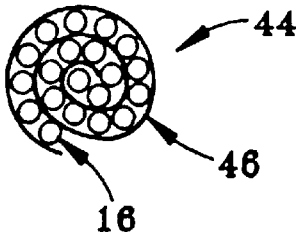
FIG. 3*c* depicts a substantially schematic view of a cross-section of an alternate embodiment probe for a densitometer based magnetic sensor of the instant invention.

FIG. 3*c* depicts an even simpler alternate embodiment probe 44. Probe 44 is accomplished by spreading ferromagnetic shot 16 randomly on the adhesive side of a tape 46, having adhesive on one side, such that the longitudinal linear density d simulates the linear density of shot 16 when the shot peening system is operating at desired parameters. As with probes 24 and 34 it is recognized that proper calibration may be accomplished with other linear densities. Tape 46 is rolled upon itself along its width creating probe 44 which may be placed in the inductance field 14.

When employing a probe 34 or 44 which does not fill the entire inner diameter of the portion of the shot peening system employing sensor 12 the probe should be kept close to centered in nozzle 10 to acquire a proper reading from inductance field 14 as one skilled in the art will recognize. Preferably, however, extra tape will be added to the outer diameter of the probe 34, 44 to expand the diameter of said probe to approximately that of the sensor to be calibrated.

Because the dielectric constant of a densitometer based capacitance sensor will change due to any material, not just ferromagnetic material as with a densitometer based magnetic sensor, probes 24, 34 and 44 would not obtain the true calibration constant of a densitometer based capacitance sensor using the above process. This is due to the effect material 30, rod 38 and tapes 36, 40 and 46 would have on the dielectric constant.

Figure 3D:
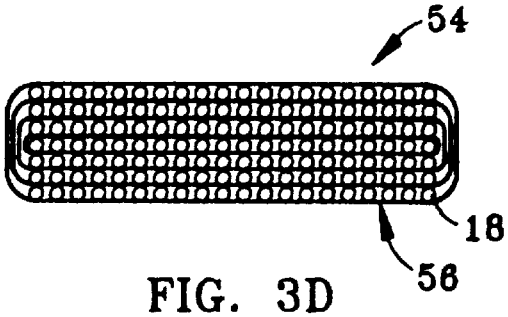
FIG. 3*d* depicts a substantially schematic view of a longitudinal cross-section of a probe for a densitometer based capacitance sensor of the instant invention.

As depicted in FIG. 3*d*, probe 54 should be constructed in the form of probe 44 using a material 56 possessing as low of a dielectric constant as can be obtained. The small amount of material 56 with low dielectric constant alters the combined dielectric constant of the shot 18, which may be ferromagnetic or non-ferromagnetic material, and material 56 by only a small amount. If the dielectric constant of material 56 is low enough, the effect of material 56 on the output of sensor 20 during calibration may be ignored.

Alternatively, the known density of the probe can be altered by the density of material 56 before being placed into equation (2) to determine the calibration constant K and thereby eliminating the distorting effect material 56 would have on the calculation of calibration constant K. It is recognized that numerous variations and modifications of probe 54 would accomplish the instant invention.

It is to be recognized that the foregoing detailed description of the preferred embodiment of the instant invention is given merely by way of illustration, and that numerous modifications and variations may become apparent to those skilled in the art without departing from the spirit and scope of the invention. Therefore, the scope of the present invention is to be determined by reference to the appended claims.

I claim:

1. A probe means for determining a calibration constant of a densitometer based sensor, said probe means comprising:

a nozzle shaped encasing material for holding a plurality of disparate particle means; and a plurality of disparate particle means substantially simulating a plurality of disparate shot peening particles embedded in said material.

2. A probe means for determining a calibration constant of a densitometer based sensor employed for determining the linear density of a plurality of shot particles in a portion of a shot peening system, said probe means comprising:

a nozzle shaped separating material for holding a plurality of disparate particle means; and a plurality of disparate particle means substantially simulating a plurality of disparate shot peening particles configured with a predetermined linear density embedded in said material.

3. The probe means of claim 2 wherein the plurality of disparate particles is ferromagnetic and the material is polyethylene.

4. A probe means for determining a calibration constant of a densitometer based sensor, said probe means comprising:

a plurality of disparate particle means, substantially simulating a plurality of disparate shot peening particles;

a separating material for holding the plurality of disparate particle means; and said separating material comprises a tape rolled upon itself and holding some of the plurality of particle means between each layer of the rolled tape.

5. A probe means for determining a calibration constant of a densitometer based sensor employed for determining the linear density of a plurality of shot particles in a portion of a shot peening system, said probe means comprising:

a plurality of disparate particle means substantially simulating a plurality of disparate shot peening particles configured with a predetermined linear density;

a separating material for holding the plurality of disparate particle means; and said separating material comprises a tape rolled upon itself and holding some of the plurality of particle means between each layer of the rolled tape.

* * * * *